United States Patent [19]

Wilkerson

[11] 4,324,165

[45] Apr. 13, 1982

[54] CAPO

[76] Inventor: James W. Wilkerson, Highway 64 East, Savannah, Tenn. 38372

[21] Appl. No.: 127,868

[22] Filed: Mar. 6, 1980

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 390,612 | 10/1888 | Moffat | 84/318 |
| 489,525 | 1/1893 | Dahlman | 84/318 |
| 3,647,930 | 3/1972 | Wowries | 84/318 |
| 4,183,279 | 1/1980 | Shabram | 84/318 |

*Primary Examiner*—Lawrence R. Franklin

*Attorney, Agent, or Firm*—Harrington A. Lackey

[57] ABSTRACT

A capo including a top pressure bar and a pivotally mounted bottom pressure bar projecting from a frame, respectively, above and below the neck of a stringed musical instrument. A manual lever pivotally mounted on the frame carries a bearing member for engaging the mounting arm in order to swing the bottom pressure bar toward and away from engagment with the bottom surface of the neck in response to the movement of the manual lever, the top pressure bar being adapted to force the strings against the fret board in operative position in order to raise the pitch of the instrument when the lever has forced the bottom pressure bar against the bottom surface of the instrument.

6 Claims, 5 Drawing Figures

Fig. 1
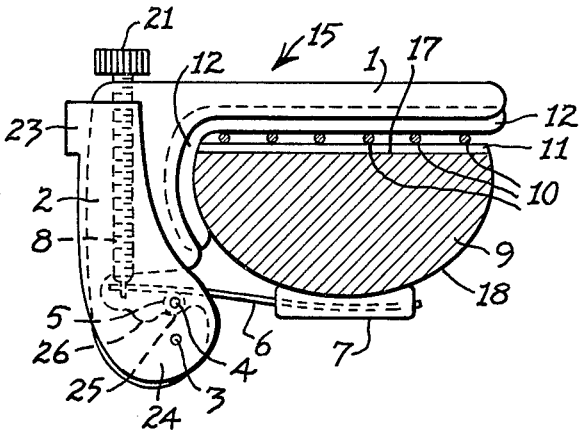
Fig. 2
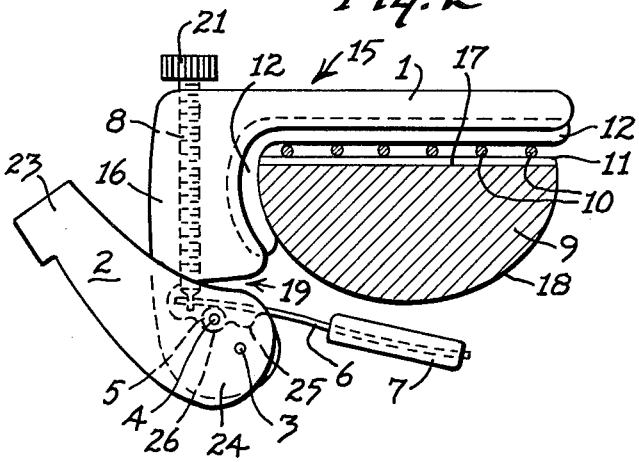
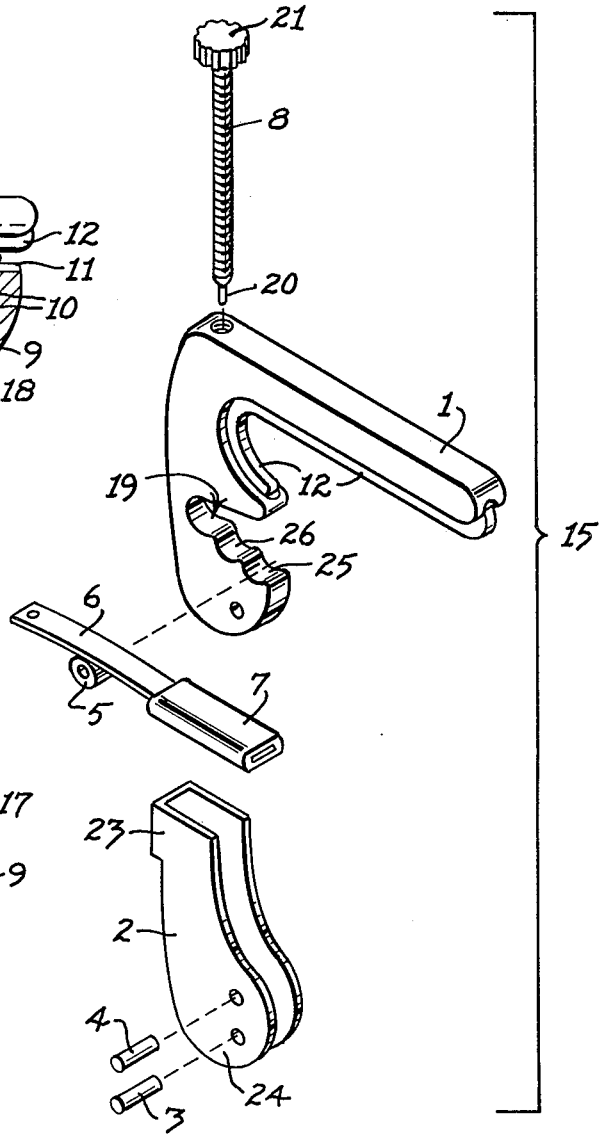
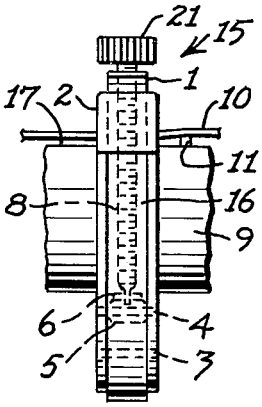
Fig. 3
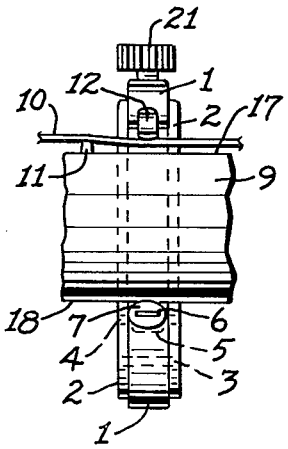
Fig. 4
Fig. 5

CAPO

BACKGROUND OF THE INVENTION

This invention relates to a capo for attachment to the neck of a stringed musical instrument, in order to raise the pitch of the instrument.

Capos of various construction are well known in the art. Examples of such capos are illustrated in the following patents:

| U.S. Pat. Nos. | |
|---|---|
| 3,722,346 Valentino | March 27, 1973 |
| 3,823,247 Bauerfeind | July 9, 1974 |
| 3,933,073 Hutchins | January 20, 1976 |
| 4,048,894 Myerson et al | September 20, 1977 |
| 4,104,947 Oster | August 8, 1978 |
| Foreign Patents | |
| German patent 382,448 | October 2, 1923 |

All of the above patents disclose various types of capos having a top pressure bar and a lower pressure member connected to the top pressure bar for either swinging or translatory relative movement between the top pressure bar and the lower pressure member.

All of the capos disclosed in the above patents are provided with different types of structure for holding the top pressure bar in engagement with the strings and the fret board, and for releasing the top pressure bar.

However, none of the above capos include a pivotally mounted bottom pressure bar which is moved toward and away from the top pressure bar by means of a bearing member carried by a pivotal lever for operatively engaging the bottom pressure bar, in order to gain a substantial mechanical advantage.

SUMMARY OF THE INVENTION

It is therefore an object of this invention to provide a capo having a top pressure bar and a bottom pressure bar operatively connected by a lever mechanism, including a manually operated lever, for moving the pressure bars toward and away from each other about the neck of a stringed musical instrument.

The capo made in accordance with this invention also includes means for latching the pressure bars against the neck of the stringed musical instrument in their clamping position.

The capo made in accordance with this invention also includes means for adjusting the bottom pressure bar against the neck of the guitar in operative clamping position.

More specifically, the capo made in accordance with this invention includes a frame adapted to be disposed along one side of the neck of a stringed musical instrument, such as a guitar, and a top pressure bar fixed to and projecting laterally from the frame across the fret board and adapted to engage and press the strings against the fret. A bottom pressure bar is pivotally mounted upon the frame and is operatively engaged by a bearing member carried by a manual lever pivotally connected to the frame for swinging movement between a clamping position and a release position.

In the preferred form of the invention, the bearing member is a roller bearing journaled upon the lever to give a substantial mechanical advantage and is adapted to be seated in a locking recess in the frame when the lever has been swung to a clamping position, forcing the bottom pressure bar against the bottom surface of the instrument neck and thereby forcing the top pressure bar against the strings of the fret board.

The amount of pressure exerted by the bottom pressure bar upon the instrument neck in its clamping position may be adjusted by a threaded adjusting member adapted to travel in a corresponding threaded opening within the frame and having one end operatively connected to one end of the mounting arm supporting the bottom pressure bar, thereby adjusting the pivotal position of the bottom pressure bar. Such adjustment may also be made in order to adjust the spacing between the top and bottom pressure bars to fit about necks of different sizes of stringed musical instruments.

BRIEF DESCRIPTION OF THE DRAWINGS

FIG. 1 is a front elevation of the capo made in accordance with this invention in its operative clamping position about the neck of a stringed musical instrument, shown in transverse section;

FIG. 2 is a view similar to FIG. 1, with the capo disclosed in its release position;

FIG. 3 is a left end elevation of the capo disclosed in FIG. 1 with the instrument neck shown fragmentarily;

FIG. 4 is a right end elevation of the capo disclosed in FIG. 1, with the instrument neck shown fragmentarily; and FIG. 5 is an exploded, top perspective view of the capo, illustrating the separate parts of the capo and their method of assembly.

DESCRIPTION OF THE PREFERRED EMBODIMENTS

Referring now to the drawings in more detail, the capo 15 made in accordance with this invention includes a side frame 16 having a height slightly greater than the depth of the neck 9 of a stringed musical instrument upon which the capo 15 is to be used. The neck 9 includes a fingerboard or fret board 17, a rounded bottom surface 18, a plurality of longitudinally spaced transverse frets 11 mounted on the fret board 17 supporting a plurality of strings 10 disposed parallel to the longitudinal axis of the neck 12.

Fixed to and projecting laterally from the side frame 16 is the top pressure bar 1 having a length sufficient to span the entire transverse dimension of the neck 9 when in operative position, as disclosed in FIGS. 1 and 2.

Mounted within a corresponding L-shaped groove formed in the bottom surface of the top pressure bar 1 and the frame 16 is a corresponding L-shaped resilient pressure pad 12, which provides a soft surface for engaging the strings 10 transversely, not only to prevent damage to the strings 10, but also to provide more uniform pressure to the strings to prevent altering their pitch from standard. The particular material from which the pressure pad 12 is made is preferably rubber of narrow width, in the order of $\frac{1}{8}$ inch and having a durometer hardness number of approximately 60. The elasticity or hardness of the rubber material of the pressure pad 12 is such that when the pressure pad 12 engages the strings 10 and is forced downward against them, the strings 10 will depress the corresponding contact areas of the rubber surface permitting the bottom surface areas of the pressure pad 12, not engaging the strings 10, to descend until they engage the surface of the fret board 17. Accordingly, the pressure exerted by the top pressure bar 9 upon the strings 10 will be limited when the poritions of the pressure pad 12 between the strings 10 engage the fret 11, thus preventing an increase in the pitch from standard.

Pivotally mounted within a recess 19 in the frame 16 opening toward the neck 9 is the proximal end portion of a mounting arm 6. The mounting arm 6 is preferably an elongated flat steel spring member, or other semi-elastic member. The remote end portion of the mounting arm 6 supports, or terminates in, a bottom pressure bar 7, illustrated in the drawings as an elastic sleeve member of soft material for yieldingly engaging the bottom surface 18 of the instrument neck 9. The mounting arm 6 and bottom pressure bar 7 extend in substantially the same transverse direction as the top pressure bar 1, but beneath the neck 9.

The proximal end of the mounting arm 6 is pivotally connected to an elongated vertically extended threaded adjustment screw 8, threaded in a corresponding internally threaded hole in the frame 16. The bottom end of the adjustment screw 8 terminates in a pointed end portion 20 which is adapted to loosely extend through a corresponding vertical hole in the proximal end portion of the mounting arm 6. The upper end of the adjustment screw 8 terminates in an enlarged knurled head 21 adapted to be manually rotated in order to turn the screw 8 for vertical travel within the frame 16. Thus, by turning the head 21, the bottom end 20 as well as the connected proximal end portion of the mounting arm 6 will be vertically adjusted in order to vary the pivotal axis of the bottom pressure bar 7.

A manually operated lever member 2 having an upper handle portion 23 and a lower operative portion 24 is pivotally mounted at its lower end portion by a pivot pin 3 to the frame 16. As disclosed in the drawings, the lever member 2 is bifurcated so that its lower operative portion 24 forms a pair of arms straddling both sides of the frame 16.

Journaled upon an axle pin 4 fixed between the bifurcated arms of the lower operative portion 24 is a roller bearing 5 rotatably mounted about an axis parallel to the longitudinal axis of the instrument neck 9. The roller bearing 5 is preferably located close to the pivotal axis of the lever member 2, that is closer to the pivot pin 3 than to the upper end portion 23 of the lever 2, in order to provide a substantial mechanical advantage or leverage for the clamping action of the bottom pressure bar 7 against the instrument neck 9.

The roller bearing member 5 is also located so that it is free to move within the open slot 19 as the lever 2 is swung between its clamping position of FIG. 1 and the release position of FIG. 2. The roller bearing 5 is also designed to constantly engage the lower surface of the mounting arm 6, causing the bottom pressure bar 7 to rise as the lever 2 moves toward the instrument neck 9. Accordingly, when the lever 2 is in its upright clamping position as disclosed in FIG. 1, the pressure bar 7 is squeezed firmly against the bottom surface 18 of the instrument neck 9, thereby forcing the top pressure bar 1 down upon the strings 10.

The bottom surface of the slot 19 is provided with a pair of locking recesses 25 and 26. As the lever 2 moves from its release position disclosed in FIG. 2 to its clamping position disclosed in FIG. 1, the roller bearing 5 rolls from its seated position in the locking recess 26 to its seated position within the locking recess 25. When the roller bearing 5 is in the locking recess 25, the lever 2 and the bottom pressure bar 7 are latched or locked in their clamping position, until sufficient force is exerted upon the lever 2 away from the frame 16 to cause the roller bearing 5 to roll out of its locking recess 25 and subsequently into the locking recess 26.

By first adjusting the adjustment screw 8, while the lever 22 is in its release position disclosed in FIG. 2, the pivotal position of the proximal end of the mounting arm 6 at its connection with the pointed end 20 of the threaded screw 8 is vertically adjusted, thereby adjusting the amount of pressure exerted by the bottom pressure bar 7 and the top pressure bar 1 upon the instrument neck 9 when the lever 2 is in clamping position, as disclosed in FIG. 1.

After the adjustment screw 8 has been manually adjusted to the desired tension pressure of the bottom pressure bar 7 against the bottom surface 18 of the neck 9, the top pressure bar 1 is then placed transversely over the fret board 17 so that the transverse pressure pad 12 will transversely engage all of the strings 10 at the desired longitudinal position adjacent a transverse fret 11. In this release position, the bottom pressure bar 7 is extended under, but spaced from the bottom surface 18 of the neck 9, as illustrated in FIG. 2. The lever 2 is then moved toward the neck 9 about the hinge pin 3 to swing in a clockwise direction, simultaneously causing the roller bearing 5 to move from its seat in the recess 26 across the barrier between the recesses 26 and 25 and into seated engagement with the locking recess 25. As the roller bearing 5 travels inward toward the neck 9, its constant engagement with the mounting arm 6 forces the mounting arm 6 and the bottom pressure bar 7 up toward and ultimately into engagement with the rounded bottom surface 18 of the instrument neck 9, as illustrated in FIG. 1. In this clamping position, the top pressure bar 1 is squeezed down toward the top surface 17, causing the rubber pressure pad 12 to press down and around the strings 10 until the pressure pad 12 engages the fret board 17, thereby eliminating any further pressure against the strings 10 while the capo 15 is in clamping position.

Thus, a capo 15 has been provided which is easily manipulated in order to clamp the top pressure bar 1 down against the strings 17 quickly and with an automatic latching action, eliminating any additional manipulation in order to lock the top pressure bar 1 and the bottom pressure bar 7 in their clamping positions.

When it is desired to release the capo 15 from the instrument neck 9, the lever 2 is merely thrust in a counterclockwise direction about the pivot pin 3 away from the frame 16 until the roller bearing 5 has been unseated from the locking recess 25 and forced to its seat within the recess 26 which holds the lever in a release position, such as that disclosed in FIG. 2. In the release position, the roller bearing 5 has been effectively lowered relative to the mounting arm 6 to permit the bottom pressure bar 7 to drop away from its engagement with the bottom surface 18 of the instrument neck 9.

What is claimed is:

1. A capo for attachment to the neck of a stringed musical instrument, said neck having a longitudinal axis, opposite sides, a fret board and a bottom surface, transverse frets disposed on said fret board and a plurality of strings disposed parallel to said longitudinal axis, comprising:

(a) a frame, (b) an elongated top pressure bar projecting from said frame and adapted to extend transversely of said longitudinal axis over the fret board of a stringed musical instrument and to engage the strings of the instrument when said frame is located along one side of said neck in operative position, (c) an elongated mounting arm having a remote end portion comprising a bottom pressure bar, a proximal end portion, and an elongated, semi-elastic, intermediate portion extending between said bottom pressure bar and said proximal end portion, (d) means pivotally mounting said proximal end portion on said frame to support said bottom pressure bar transversely beneath the neck in operative position for swinging movement toward and away from the bottom surface of the stringed musical instrument, (e) a manual lever having a handle portion and an operative end portion, (f) means journaling said operative end portion on said frame for swinging movement of said lever about a pivotal axis substantially parallel to said longitudinal axis, between a clamping position and a release position, (g) a transverse bearing member mounted on said lever between said pivotal axis and said handle portion and projecting parallel to said longitudinal axis beneath said mounting arm, (h) said bearing member being adapted to engage said semi-elastic intermediate portion and to cause said bottom pressure bar to swing toward and engage the bottom surface of the stringed musical instrument when said frame is in operative position and said lever is moving toward said clamping position, and to cause said bottom pressure bar to move away from the bottom surface of the neck when said lever is moving toward said release position.

2. The invention according to claim 1 in which said mounting arm comprises an elongated spring member.

3. The invention according to claim 1 in which said bearing member comprises a roller bearing member journaled on said lever.

4. The invention according to claim 1 comprising means for adjusting the position of said pivotally mounting means in order to adjust the pressure of said bottom pressure bar against the bottom surface of the neck of the musical instrument in clamping position.

5. The invention according to claim 4 in which said adjusting means comprises a screw member secured in said frame for axial travel, said screw member being operatively connected to said proximal end portion comprising said pivotally mounting means.

6. The invention according to claim 1 in which manual lever is in a generally upright position in said clamping position, the upper portion of said lever comprising said handle portion and the lower portion of said lever comprising said operative end portion.

* * * * *